US011316278B2

(12) United States Patent
Wu et al.

(10) Patent No.: US 11,316,278 B2
(45) Date of Patent: Apr. 26, 2022

(54) MOBILE TERMINAL AND GLASS HOUSING THEREOF, AND PERFORMANCE OPTIMIZATION METHOD OF ANTENNA MODULE THEREOF

(71) Applicant: AAC Technologies Pte. Ltd., Singapore (SG)

(72) Inventors: Jing Wu, Shenzhen (CN); Chao Wang, Shenzhen (CN); Zhiqiang Zhuang, Shenzhen (CN); Ke Hua, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/990,952

(22) Filed: Aug. 11, 2020

(65) Prior Publication Data

US 2020/0412006 A1 Dec. 31, 2020

Related U.S. Application Data

(63) Continuation of application No. PCT/CN2019/094045, filed on Jun. 30, 2019.

(51) Int. Cl.
*H01Q 15/08* (2006.01)
*H01Q 1/24* (2006.01)

(52) U.S. Cl.
CPC ..... *H01Q 15/08* (2013.01); *H01Q 1/243* (2013.01)

(58) Field of Classification Search
CPC ..... H01Q 15/08; H01Q 1/243; H01Q 1/421
USPC ..... 455/575.1, 575.7; 343/702; 428/34.4, 428/410
See application file for complete search history.

(56) References Cited

U.S. PATENT DOCUMENTS 9,674,965 B1 * 6/2017 Salinger ..... H05K 5/0086
2002/0122902 A1 * 9/2002 Ueda ..... C03B 19/1453 428/34.4
2010/0103612 A1 * 4/2010 Weber ..... H05K 5/0247 361/679.56
2011/0186345 A1 * 8/2011 Pakula ..... H05K 5/0086 174/520
2011/0188179 A1 * 8/2011 Myers ..... H04M 1/026 361/679.01
2012/0069517 A1 * 3/2012 Prest ..... G02F 1/13439 361/679.56
2012/0176277 A1 * 7/2012 Malek ..... G01R 33/02 343/702
2012/0176755 A1 * 7/2012 Malek ..... H05K 3/32 361/752
2013/0099983 A1 * 4/2013 Han ..... H01Q 21/29 343/702
2015/0166401 A1 * 6/2015 Yamamoto ..... C03C 4/02 428/410

(Continued)

*Primary Examiner* — Tan H Trinh
(74) *Attorney, Agent, or Firm* — W&G Law Group

(57) ABSTRACT

The invention provides a mobile terminal, a glass housing, and a performance optimization method of an antenna module of the mobile terminal. The mobile terminal is internally provided with the antenna module. The glass housing includes a radiation zone facing the antenna module and a non-radiation zone adjacent to the radiation zone. The glass shape of the radiation zone and the glass shape of the non-radiation zone are of discontinuity. The glass housing of the mobile terminal provided by the invention can optimize performance of the antenna module.

13 Claims, 10 Drawing Sheets

(56) References Cited

U.S. PATENT DOCUMENTS

| | | | | |
|---|---|---|---|---|
| 2015/0266771 | A1* | 9/2015 | Miyasaka | C03C 3/097 428/34.4 |
| 2018/0146348 | A1* | 5/2018 | Singh | H04L 51/22 |
| 2018/0184532 | A1* | 6/2018 | Kim | H05K 5/0226 |
| 2018/0191060 | A1* | 7/2018 | Wu | H01Q 5/371 |
| 2019/0005367 | A1* | 1/2019 | Yamada | G06K 19/077 |
| 2019/0073961 | A1* | 3/2019 | Park | G02F 1/136286 |
| 2019/0171254 | A1* | 6/2019 | Kim | G06F 1/1647 |
| 2019/0229402 | A1* | 7/2019 | Xia | H01Q 1/243 |
| 2020/0026327 | A1* | 1/2020 | Hendren | G06F 1/1662 |
| 2020/0212542 | A1* | 7/2020 | Yong | H01Q 3/34 |
| 2020/0348731 | A1* | 11/2020 | Jung | G06F 1/1616 |

* cited by examiner

MOBILE TERMINAL AND GLASS HOUSING THEREOF, AND PERFORMANCE OPTIMIZATION METHOD OF ANTENNA MODULE THEREOF

FIELD OF THE PRESENT DISCLOSURE

The invention relates to the field of communication technologies, in particular to a mobile terminal and a glass housing thereof, and a performance optimization method of an antenna module of the mobile terminal.

DESCRIPTION OF RELATED ART 5G serves as a development and research focus in the industry all over the world and development of 5G technology and formulation of 5G standard have become consensus in the industry. International Telecommunication Union ITU has explicated three major application scenes of 5G: enhanced mobile broadband, large scale machine communication and high reliability low delay communication in the 22th session of ITU-RWP5D held in June, 2015. The three application scenes correspond to different key indexes, separately. The peak velocity of a user in the enhanced mobile broadband scene is 20 Gbps and the lowest user experience rate is 100 Mbps.

3GPP is standardizing the 5G technology. The first 5G NSA national standard has been accomplished and frozen in December, 2017. 5G independent networking standard has been accomplished on $14^{th}$, Jun., 2018.

Rich bandwidth resources of millimeter wave frequency bands guarantee the high speed transmission rate. However, it is needed to adopt an architecture of a phased array by a wireless communication system using the millimeter wave frequency bands due to several spatial loss of electromagnetic waves in the frequency bands.

An antenna serves as indispensable parts in a radio frequency front end system. System integration and packaging on the antenna and a radio frequency front end circuit become an inevitable trend of development of future radio frequency front ends while the radio frequency circuit develops toward integrated and miniaturized directions. Antenna-in-Package (AiP) technology integrating the antenna in a package carrying a chip by means of a packaging material and a packaging process gives consideration of antenna performance, cost and volume well, and is highly appreciated by wide chip and package manufacturers. At present, companies such as Qualcomm, Intel and IBM adopt the AiP technology. It is no doubt that the AiP technology will provide a good antenna solution for 5G millimeter wave mobile communication system.

As far as 5G millimeter wave frequency band is concerned, 3GPP provides several standard working frequency bands: n257 (26.5 GHz-29.5 GHz), n258 (24.25-27.5 GHz), n260 (37-40 GHZ) and n261 (27.5-28.35 GHZ). When the millimeter wave antenna module is mounted in the 3D glass housing, the glass housing has certain influence on radiation performance of the antenna module.

Therefore, it is necessary to provide an improved glass housing which improves the radiation performance of an antenna module of a mobile terminal.

SUMMARY OF THE INVENTION

One of the main objects of the present invention is to provide a glass housing of a mobile terminal with an antenna module having improved performance.

Another main of the present invention is to provide an optimization method to improve the performance of the antenna module of the mobile terminal.

In order to achieve the objects mentioned above, the present invention provide a glass housing of a mobile terminal with an antenna module, comprising: a radiation zone facing the antenna module and a non-radiation zone adjacent to the radiation zone; wherein the glass shape of the radiation zone and the glass shape of the non-radiation zone are of discontinuity.

In addition, the shapes of at least one side surface of the glass in the radiation zone and one side surface of the non-radiation zone are of discontinuity.

In addition, the glass in the radiation zone and the non-radiation zone have outer surfaces with continuous shapes, and the inner surface of the radiation zone is sunken toward the outer surface compared with the inner surface of the non-radiation zone.

In addition, the glass in the radiation zone and the non-radiation zone have inner surfaces with continuous shapes, and the outer surface of the radiation zone is sunken to the inner surface compared with the outer surface of the non-radiation zone.

In addition, the glass in the radiation zone is lens-shaped.

In addition, the radiation zone is located on the side edge or at the bottom of the glass housing, and the bottom of the glass housing is opposite to a display screen of the mobile terminal.

The present invention also provides a mobile terminal, comprising an antenna module and the glass housing as described above, wherein the glass housing covers the antenna module externally.

In addition, the antenna module faces the side edge or the bottom of the glass housing, and the bottom of the glass housing is opposite to the display screen of the mobile terminal.

The present invention further provides a performance optimization method of an antenna module, comprising steps of: providing a glass housing covering the antenna module externally; and optimizing the performance of the antenna module by changing a shape of a zone of the glass housing facing the antenna module.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

Figure 1:
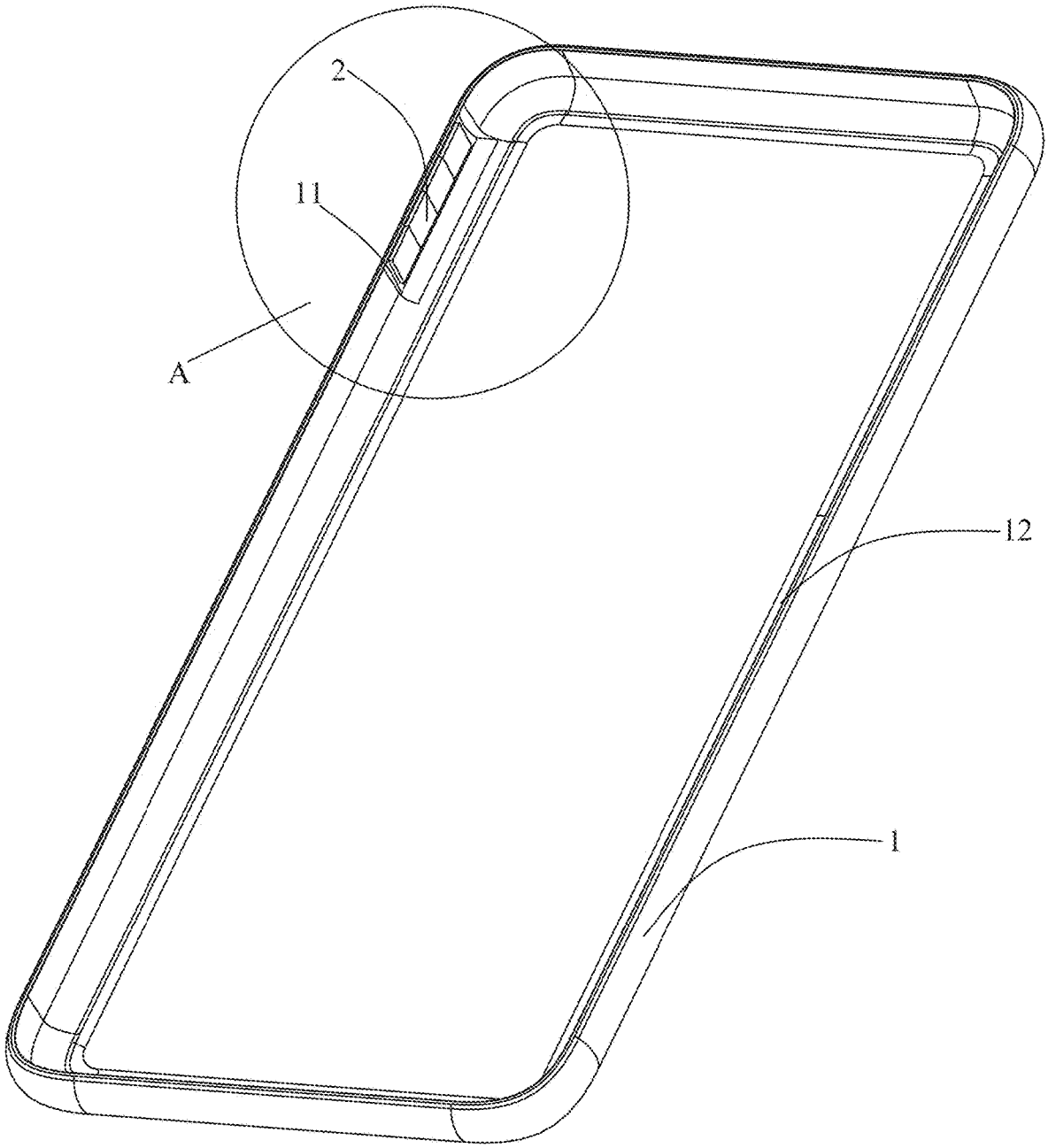
FIG. 1 is an isometric view of a glass housing in accordance with a first embodiment of the present invention.

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

It is to be noted that all directional indicators (such as upper, lower, left, right, front, back, top and bottom) in the embodiment of the invention is merely used for explaining relative position relationships among parts in a special gesture (for example, as shown in the drawings). If the special gesture changes, the directional indicators change correspondingly, too.

It should also be noted that when an element is referred to as being "fixed" or "disposed" on another element, the element may be directly on the other element or there may be intervening elements at the same time. When an element is called "connected" to another element, it may be directly connected to the other element or there may be intervening elements at the same time.

Figure 2:
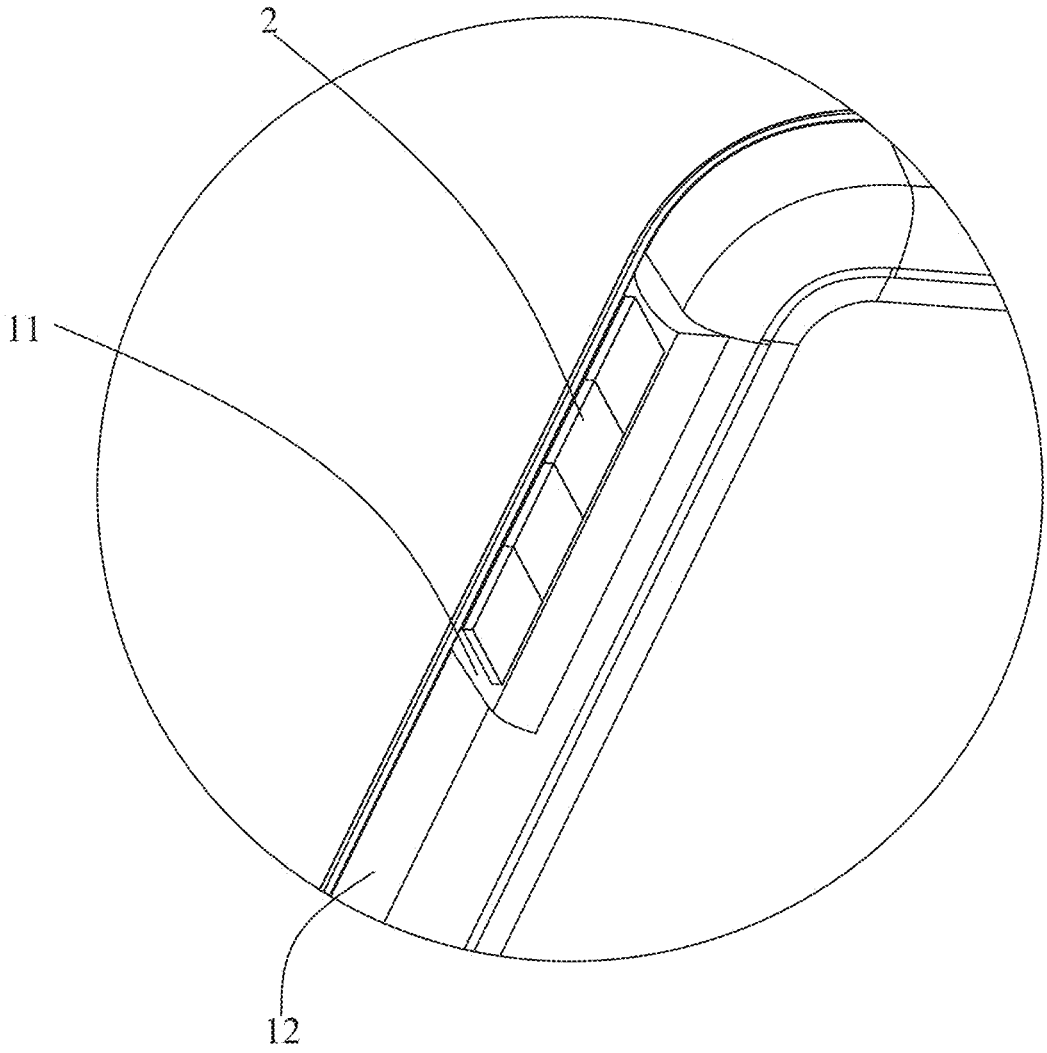
FIG. 2 is an enlarged view of Part A of the glass housing in FIG. 1.

Shown as FIG. 1 to FIG. 2, a glass housing 1 of a mobile terminal provided by the embodiment of the invention is applied to the mobile terminal. The mobile terminal is internally provided with an antenna module 2. The glass housing 1 comprises a radiation area 11 directly opposite to the antenna module 2 and a non-radiation zone 12 adjacent to the radiation area 11. The glass shape of the radiation area 11 and the glass shape of the non-radiation zone 12 are of discontinuity. The discontinuity means that the curvature of the surface of the glass housing 1 extending from the non-radiation zone 12 to the radiation area 11 changes, so that the glass shape of the radiation area 11 and the glass shape of the non-radiation zone 12 are different. For example, in an initial state, the radiation area 11 and the non-radiation zone 12 are consistent in thickness and the radiation area 11 is processed, so that the radiation area 11 is reduced or is of a lens structure. The radiation performance of the antenna module 2 can be optimized as the glass shape of the radiation area 11 and the glass shape of the non-radiation zone 12 are of discontinuity.

The radiation area 11 is located on the side surface of the glass housing 1 or at the bottom of the glass housing 1, and the bottom of the glass housing 1 is opposite to a display screen of the mobile terminal. The shapes of the surfaces of at least one sides of the glass of the radiation area 11 and the glass of the non-radiation zone 12 are of discontinuity. For example, the shapes of the inner surfaces of the glass of the radiation area 11 and the glass of the non-radiation zone 12 are of discontinuity or the shapes of the outer surfaces of the glass of the radiation area 11 and the glass of the non-radiation zone 12 are of discontinuity.

Figure 3:
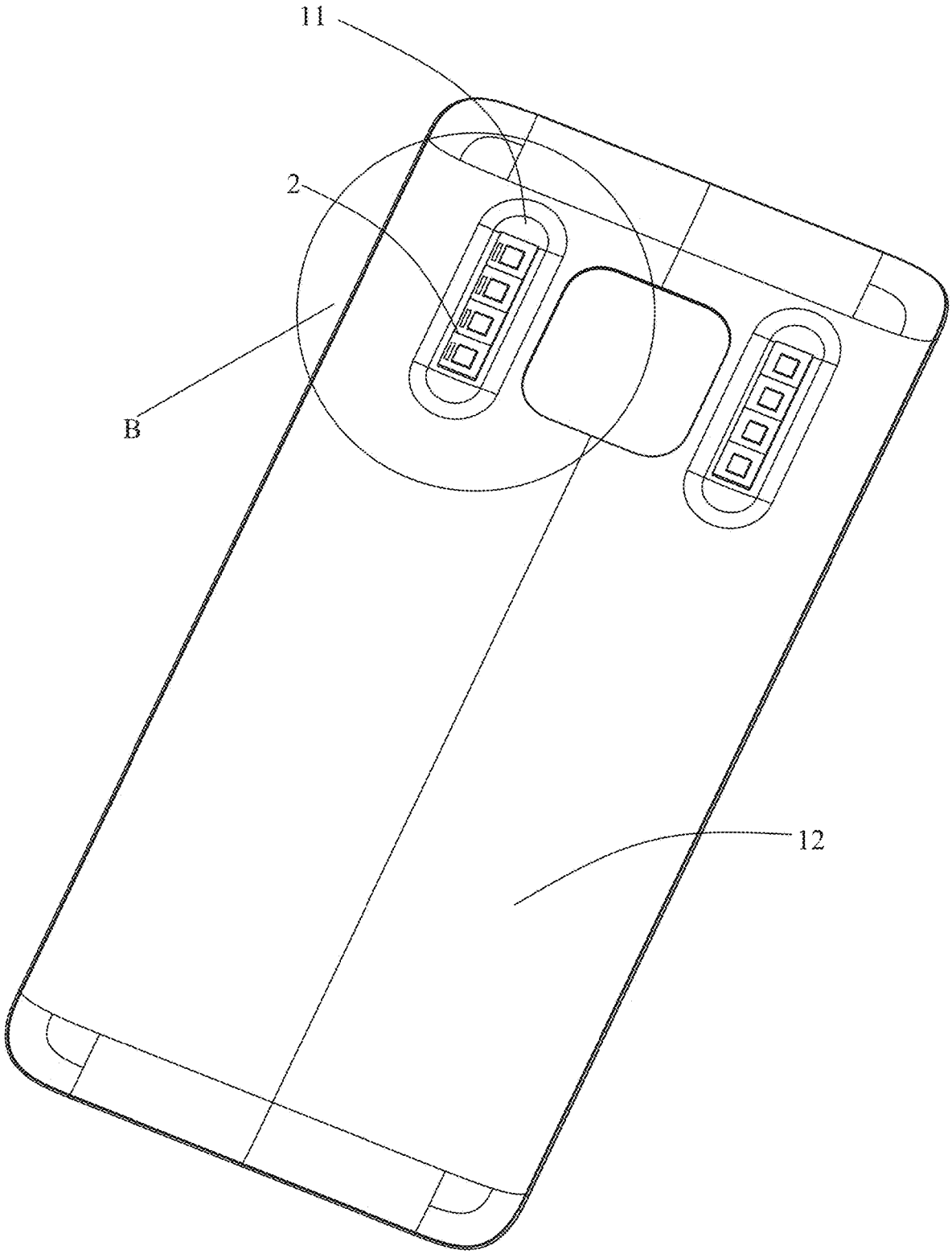
FIG. 3 is an isometric view of a glass housing in accordance with a second embodiment of the invention.
Figure 4:
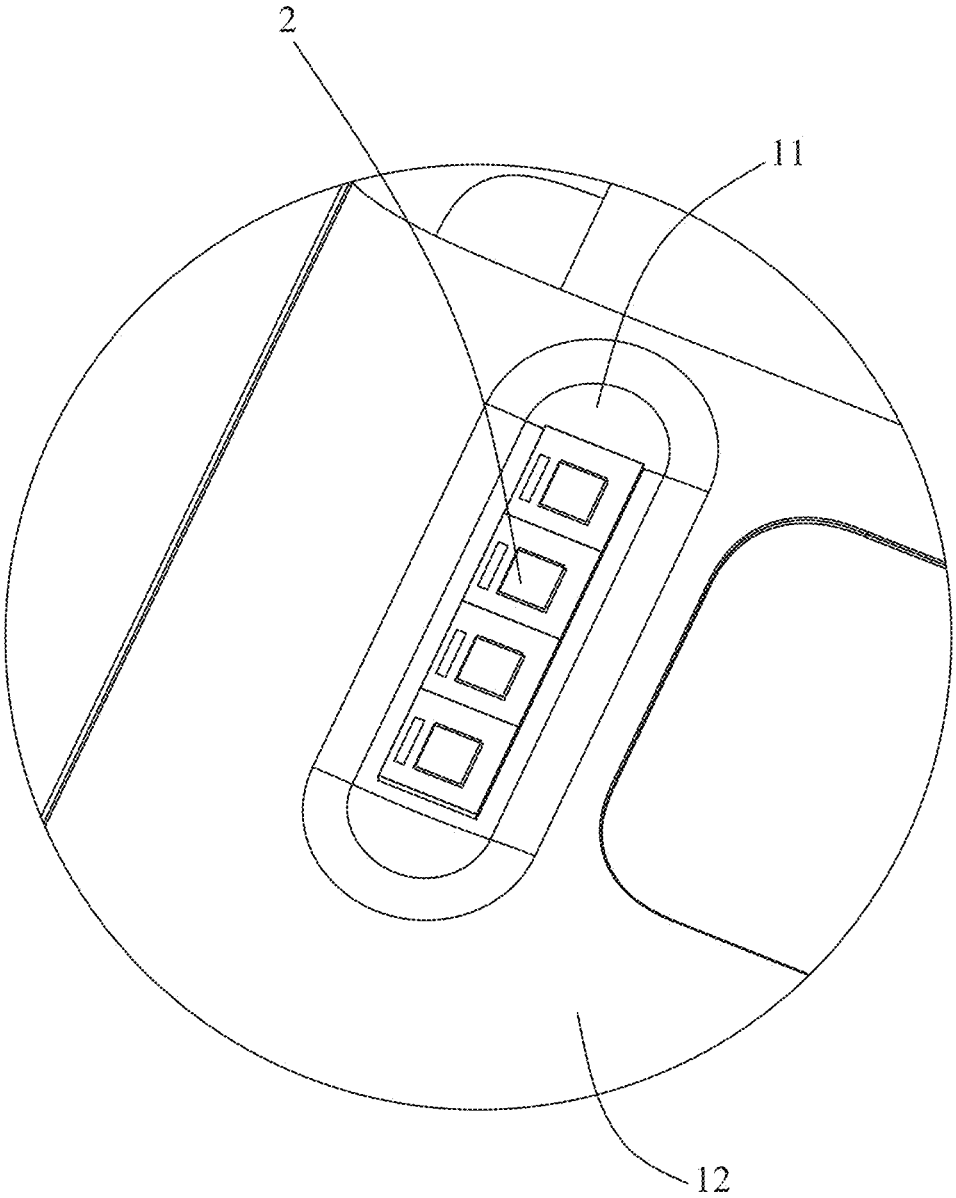
FIG. 4 is an enlarged view of Part B of the glass housing FIG. 3.

In the first embodiment, the glass of the radiation area 11 and the glass of the non-radiation zone 12 have the outer surfaces with continuous shapes, and compared with the inner surface of the non-radiation zone 12, the inner surface of the radiation area 11 is sunken toward the outer surface. Shown in the FIG. 1 to FIG. 2, the radiation area 11 is located on the side surface of the glass housing 1, the glass housing 1 with consistent thickness of the side surface is processed, so that the radiation area 11 is reduced from the inner side of the side surface of the glass housing 1, and compared with the inner surface of the non-radiation zone 12, the inner surface of the radiation area 11 is sunken toward the outer surface. Shown in the FIG. 3 to FIG. 4, the radiation area 11 is located at the bottom of the glass housing 1, the glass housing 1 with consistent bottom thickness is processed and the radiation area 11 is reduced from the inner side of the bottom of the glass housing 1, so that compared with the inner surface of the non-radiation zone 12, the inner surface of the radiation area 11 is sunken toward the outer surface.

Figure 5:
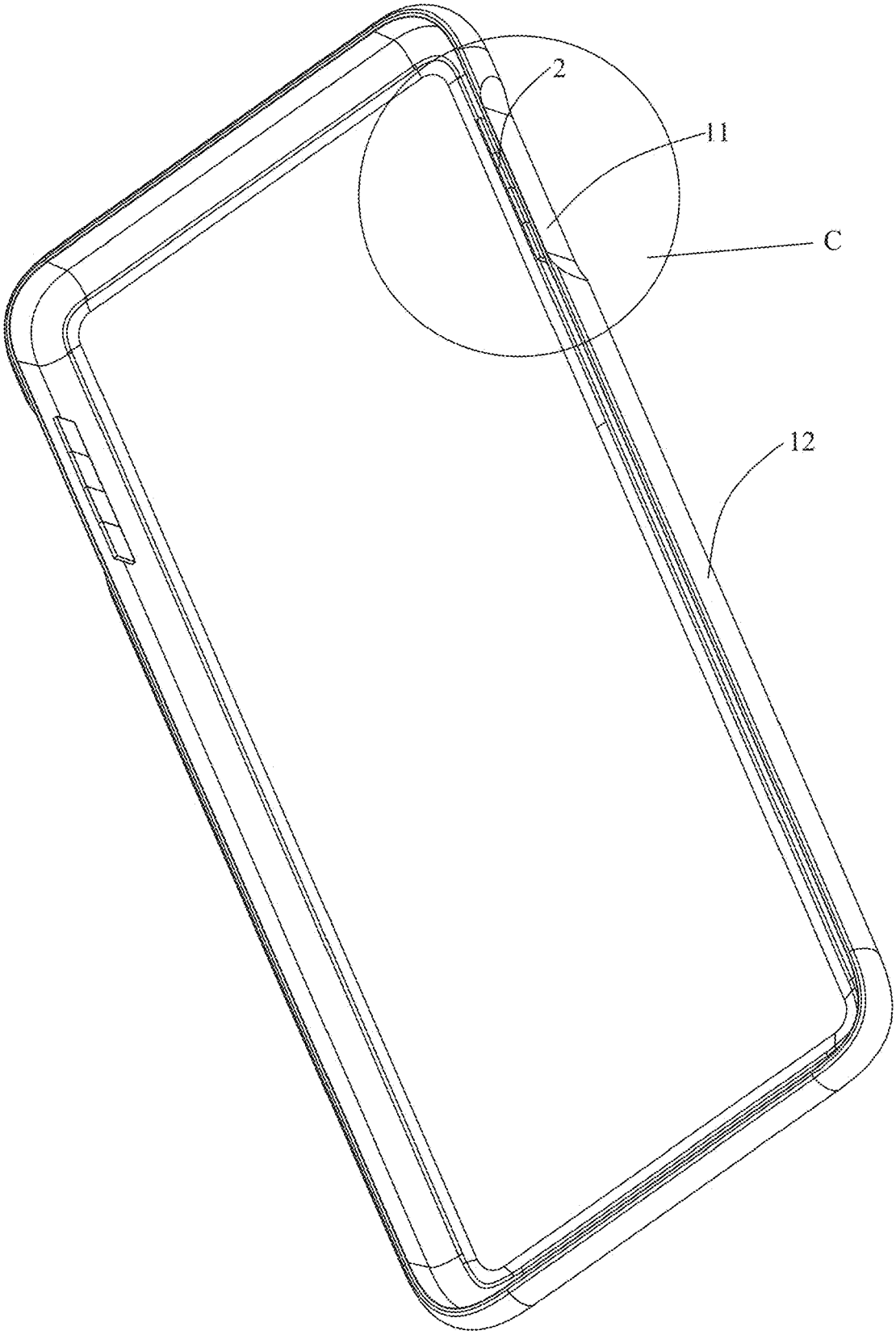
FIG. 5 is an isometric view of a third glass housing in accordance with a third embodiment of the invention.
Figure 6:
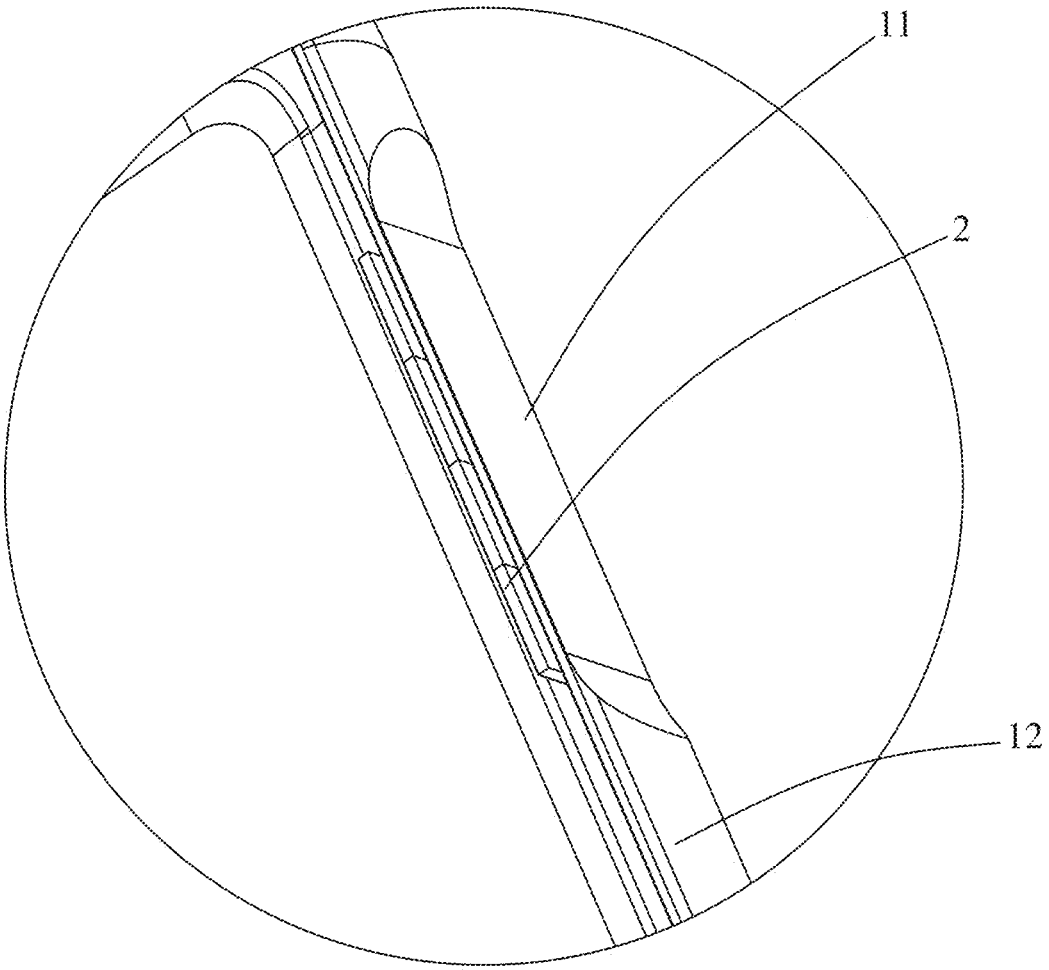
FIG. 6 is an enlarged view of Part C of the glass housing in FIG. 5.

In the second embodiment, the glass of the radiation area 11 and the glass of the non-radiation zone 12 have the inner surfaces with continuous shapes, and compared with the outer surface of the non-radiation zone 12, the outer surface of the radiation area 11 is sunken toward the inner surface. Shown in the FIG. 5 to FIG. 6, the radiation area 11 is located on the side surface of the glass housing 1, the glass housing 1 with consistent thickness of the side surface is processed, and the radiation area 11 is reduced from the outer side of the side surface of the glass housing 1, so that compared with the outer surface of the non-radiation zone 12, the outer surface of the radiation area 11 is sunken toward the inner surface. Similarly, when the radiation area 11 is located at the bottom of the glass housing 1, the glass housing 1 with consistent bottom thickness is processed, and the radiation area 11 is reduced from the outer side of the bottom of the glass housing 1, so that compared with the outer surface of the non-radiation zone 12, the outer surface of the radiation area 11 is sunken toward the inner surface.

Figure 7:
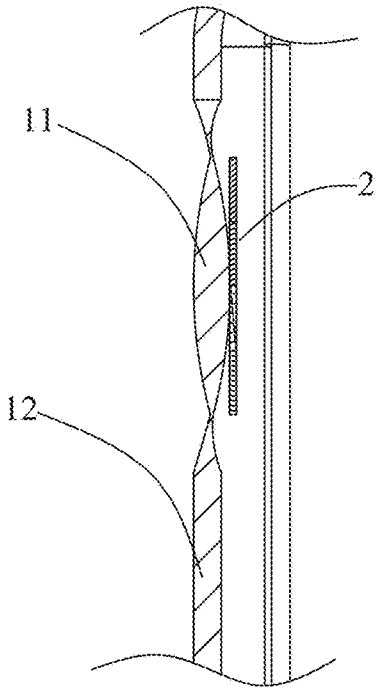
FIG. 7 is a cross-sectional view of a glass housing in accordance with a fourth embodiment of the invention.
Figure 8:
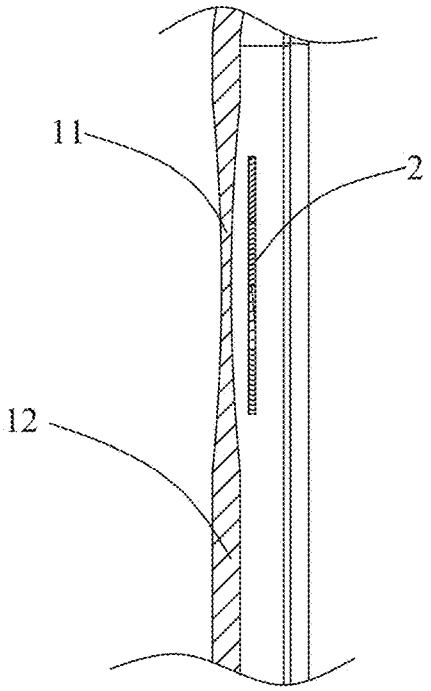
FIG. 8 is a cross-sectional view of a glass housing in accordance with a fifth embodiment of the invention.

In the third embodiment, the glass of the radiation area 11 is lens-shaped. Shown in the FIG. 7, the radiation area 11 is located on the side surface of the glass housing 1, and the glass of the radiation area 11 is in a convex lens shape. Shown in the FIG. 8, the radiation area 11 is located on the side surface of the glass housing 1, and the glass of the radiation area 11 is in a concave lens shape. Similarly, when the radiation area 11 is located at the bottom of the glass housing 1, the radiation area 11 can be also arranged as a convex lens or a concave lens.

It is to be noted that the radiation area 11 and the non-radiation zone 12 at the bottom of the glass housing 1 can be only designed in discontinuous shape, the radiation area 11 and the non-radiation zone 12 on the side surface of the glass housing 1 can be also designed in discontinuous shape, and the radiation areas 11 and the non-radiation zones 12 at the bottom and top of the glass housing 1 can be further designed in discontinuous shape without being defined hereon.

The invention further provides a mobile terminal. The mobile terminal comprises the antenna module 2 and the glass housing 1 according to any one of the embodiments. The glass housing 1 covers the antenna module 2 externally. Preferably, the antenna module 2 faces the side surface of the glass housing 1 or the bottom of the glass housing 1, and the bottom of the glass housing 1 is opposite to the display screen of the mobile terminal.

Figure 9:
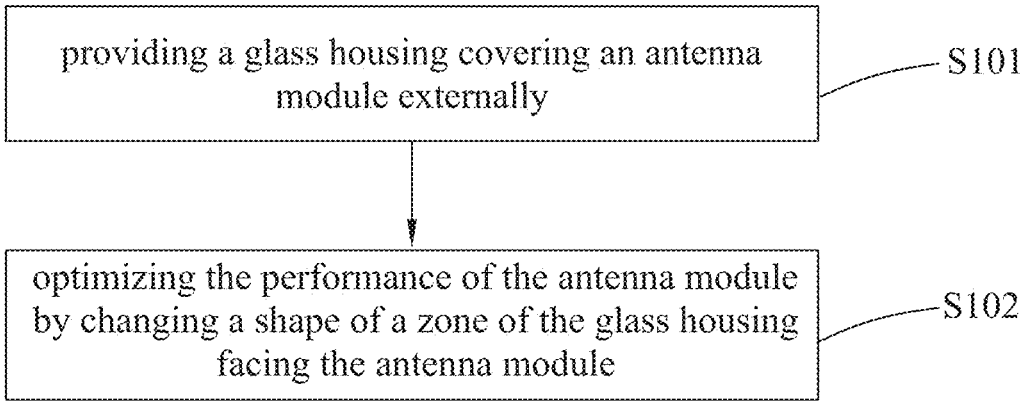
FIG. 9 is a flow chart of a performance optimization method of an antenna module provided by the invention.

Shown in the FIG. 9, the performance optimization method of the antenna module provided by the embodiment of the invention, comprising:

S101, providing a glass housing covering the antenna module externally, wherein the side surfaces of the glass housing are consistent in thickness and the bottoms of the glass housing are consistent in thickness;

and S102, optimizing the performance of the antenna module by changing the shape of a zone, facing the antenna module, of the glass housing.

Particularly, the glass housing comprises the radiation area facing the antenna module and the non-radiation zone adjacent to the radiation area. Glass housings of different shapes are constructed by simulating software. The radiation areas of the glass housings of different shapes are different in shape, the radiation performance of the antenna module corresponding to the glass housing in each shape is calculated, the shape of the glass housing with the best radiation performance of the antenna module is taken as an optimized structure, and the glass housing is processed according to the optimized structure. For example, the thickness of the radiation area is reduced from the outer side of the glass housing, the thickness of the radiation area is reduced from the inner side of the glass housing, or the radiation area is processed in a lens shape.

Figure 10:
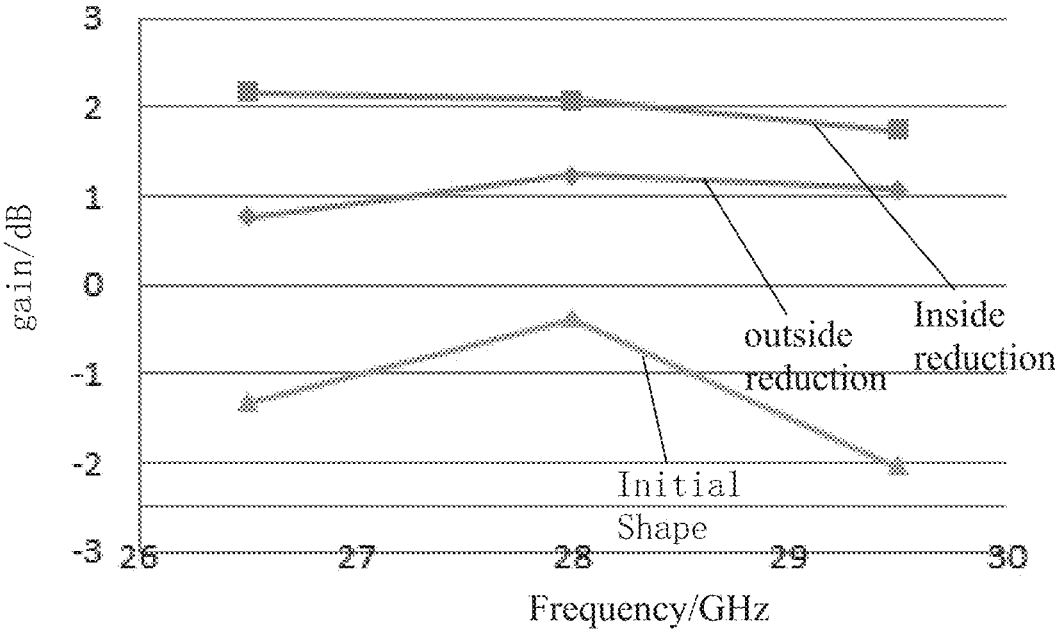
FIG. 10 is a gain curve diagram, the cumulative distribution function of which is 50%, under a side surface single module of the glass housing.
Figure 11:
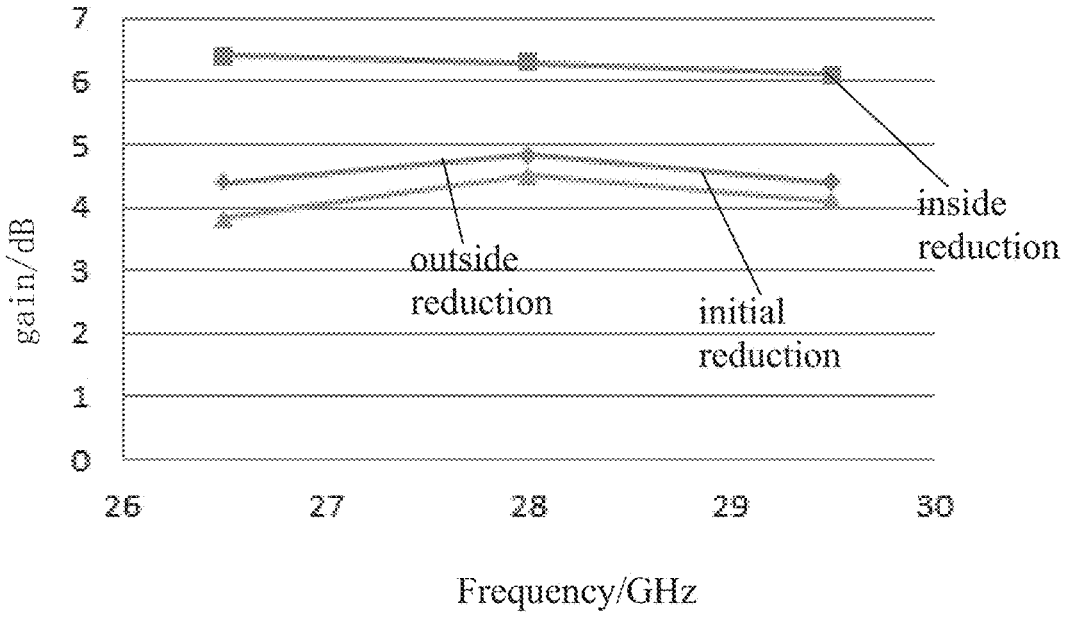
FIG. 11 is a gain curve diagram, the cumulative distribution function of which is 50%, under side surface double modules of the glass housing.

FIG. 10 is a gain curve diagram, the cumulative distribution function of which is 50%, under a side surface single module of the glass housing, and FIG. 11 is a gain curve diagram, the cumulative distribution function of which is 50%, under side surface double modules of the glass housing. The condition of double modules is shown in the FIG. 5. The antenna module is arranged on the frame of each side of the glass housing, the radiation areas corresponding to the two antenna modules are reduced, and the single module is in a condition that the antenna module is arranged on the frame on one side of the glass housing. It can be seen that compared with an initial shape of the glass housing, the single module can improve about 2 dB of 50% coverage performance by reducing the radiation areas of the glass housing and double modules can improve about 2 dB of 50% coverage performance.

Figure 12:
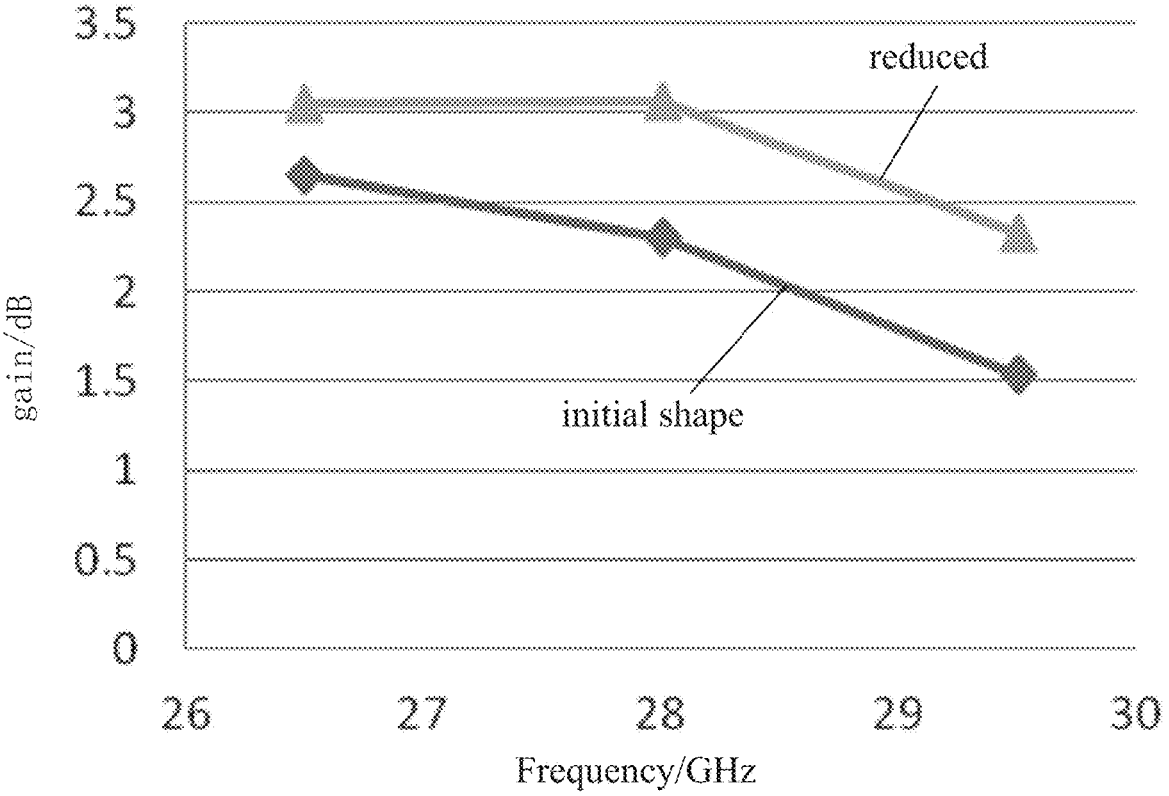
FIG. 12 is a gain curve diagram, the cumulative distribution function of which is 50%, under the bottom single module of the glass housing.
Figure 13:
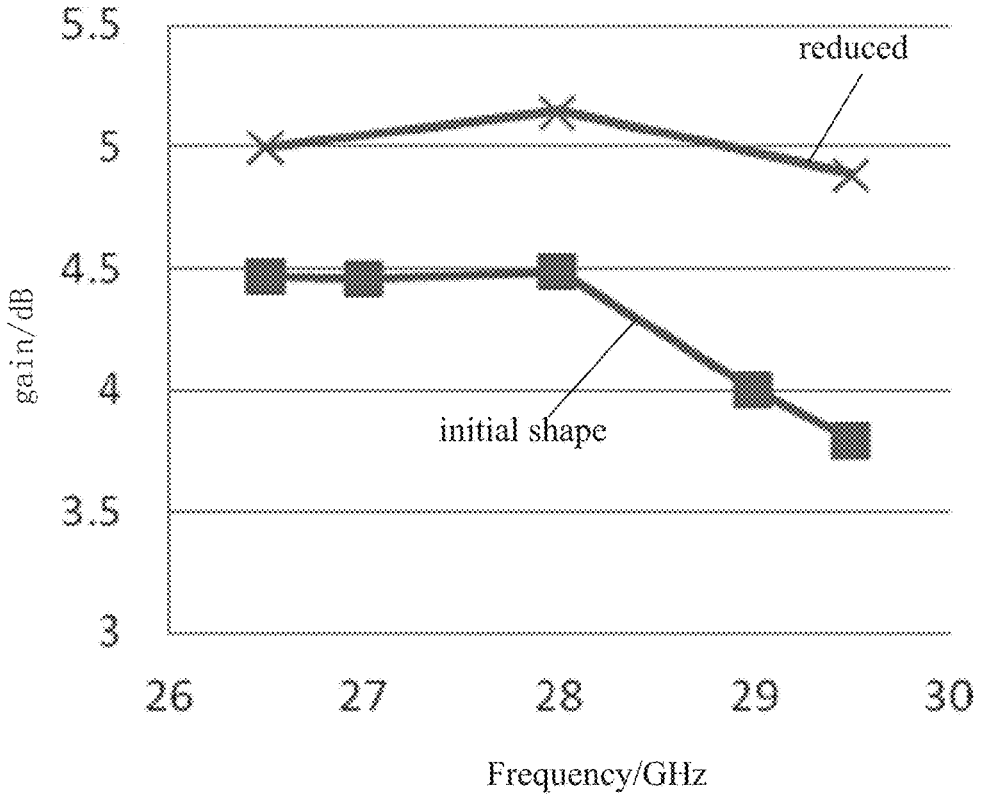
FIG. 13 is a gain curve diagram, the cumulative distribution function of which is 50%, under the bottom double modules of the glass housing.

FIG. 12 is a gain curve diagram, the cumulative distribution function of which is 50%, under a bottom single module of the glass housing, and FIG. 13 is a gain curve diagram, the cumulative distribution function of which is 50%, under bottom double modules of the glass housing. A condition of double modules is as shown in the FIG. 3. Two antenna modules are arranged at the bottom of the glass housing and the radiation zones corresponding to the two antenna modules are reduced. The single module is structured such that only one antenna module is arranged at the bottom of the glass housing. It can be seen that compared with an initial shape of the glass housing, the single module can improve about 0.5 dB of 50% coverage performance by reducing the radiation zone of the glass housing and the double modules can improve about 0.5-1 dB of 50% coverage performance.

Figure 14:
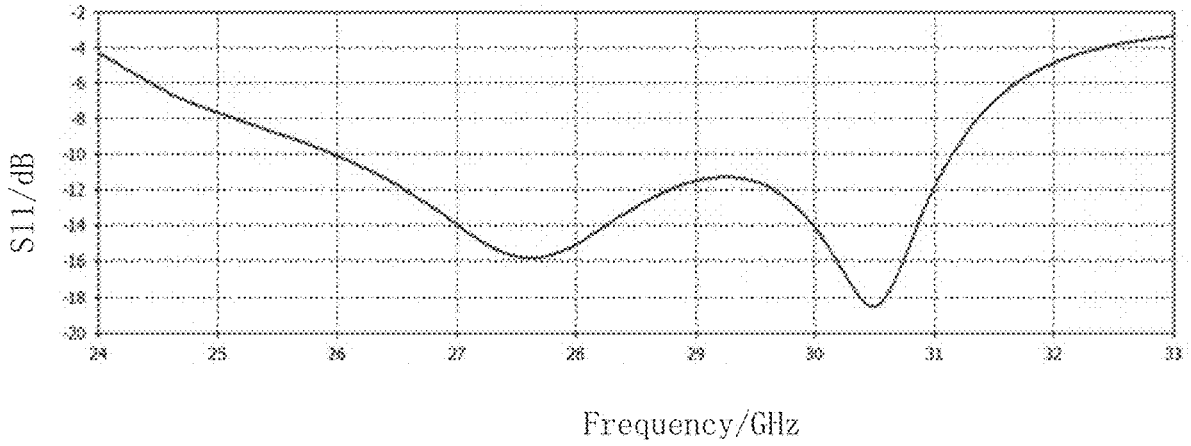
FIG. 14 is an S parameter curve diagram of the antenna module corresponding to bottom reduction of the glass housing.

FIG. 14 is an S parameter curve diagram of the antenna module corresponding to bottom reduction of the glass housing. It can be seen that by optimizing the structure of the bottom of the glass housing, standing waves of the antenna module can be improved.

According to the mobile terminal, the glass housing thereof and the performance optimization method of the antenna module provided by the embodiment of the invention, as the glass shapes of the radiation zone facing the antenna module on the glass housing and the non-radiation zone adjacent to the radiation zone are of discontinuity, performance of the antenna module is optimized.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A glass housing of a mobile terminal with an antenna module, comprising:

a radiation zone facing the antenna module and a non-radiation zone adjacent to the radiation zone; wherein the shape of the radiation zone and the shape of the non-radiation zone are of discontinuity;

wherein the glass in the radiation zone and the non-radiation zone have outer surfaces with continuous shapes, and the inner surface of the radiation zone is sunken toward the outer surface compared with the inner surface of the non-radiation zone.

2. The glass housing as described in claim 1, wherein the glass in the radiation zone and the non-radiation zone have inner surfaces with continuous shapes, and the outer surface of the radiation zone is sunken to the inner surface compared with the outer surface of the non-radiation zone.

3. A mobile terminal, comprising an antenna module and the glass housing as described in claim 2, wherein the glass housing covers the antenna module externally.

4. The mobile terminal as described in claim 3, wherein the antenna module faces the side edge or the bottom of the glass housing, and the bottom of the glass housing is opposite to the display screen of the mobile terminal.

5. The glass housing as described in claim 1, wherein the glass in the radiation zone is lens-shaped.

6. A mobile terminal, comprising an antenna module and the glass housing as described in claim 5, wherein the glass housing covers the antenna module externally.

7. The mobile terminal as described in claim 6, wherein the antenna module faces the side edge or the bottom of the glass housing, and the bottom of the glass housing is opposite to the display screen of the mobile terminal.

8. The glass housing as described in claim 1, wherein the radiation zone is located on the side edge or at the bottom of the glass housing, and the bottom of the glass housing is opposite to a display screen of the mobile terminal.

9. A mobile terminal, comprising an antenna module and the glass housing as described in claim 8, wherein the glass housing covers the antenna module externally.

10. The mobile terminal as described in claim 9, wherein the antenna module faces the side edge or the bottom of the glass housing, and the bottom of the glass housing is opposite to the display screen of the mobile terminal.

11. A mobile terminal, comprising an antenna module and the glass housing as described in claim 1, wherein the glass housing covers the antenna module externally.

12. The mobile terminal as described in claim 11, wherein the antenna module faces the side edge or the bottom of the glass housing, and the bottom of the glass housing is opposite to the display screen of the mobile terminal.

13. A performance optimization method of an antenna module, comprising steps of:

providing a glass housing covering the antenna module externally; and optimizing the performance of the antenna module by changing a shape of a zone of the glass housing facing the antenna module;

the glass housing of a mobile terminal comprising:

a radiation zone facing the antenna module and a non-radiation zone adjacent to the radiation zone; wherein the shape of the radiation zone and the shape of the non-radiation zone are of discontinuity;

wherein the glass in the radiation zone and the non-radiation zone have outer surfaces with continuous shapes, and the inner surface of the radiation zone is sunken toward the outer surface compared with the inner surface of the non-radiation zone.

* * * * *